US009194652B2

(12) United States Patent
Esserman et al.

(10) Patent No.: US 9,194,652 B2
(45) Date of Patent: Nov. 24, 2015

(54) MODULAR ACCESSORY SYSTEM FOR RIFLE

(71) Applicant: Matthew J. Esserman, Philadelphia, PA (US)

(72) Inventors: Matthew J. Esserman, Philadelphia, PA (US); Charles Rubac, Bethesda, MD (US); Thomas Coughlin Maher, Alexandria, VA (US)

( * ) Notice: Subject to any disclaimer, the term of this patent is extended or adjusted under 35 U.S.C. 154(b) by 0 days.

(21) Appl. No.: 14/177,150

(22) Filed: Feb. 10, 2014

(65) Prior Publication Data

US 2014/0150317 A1 Jun. 5, 2014

Related U.S. Application Data

(63) Continuation of application No. 13/207,389, filed on Aug. 10, 2011, now abandoned.

(51) Int. Cl.

| | |
|---|---|
| ***F41C 27/00*** | (2006.01) |
| ***F41C 23/16*** | (2006.01) |
| ***F41C 23/22*** | (2006.01) |

(52) U.S. Cl.

CPC ..... *F41C 23/16* (2013.01); *F41C 23/22* (2013.01); *F41C 27/00* (2013.01)

(58) Field of Classification Search

CPC ..... F41C 23/16; F41C 23/22; F41C 27/00
USPC ..... 42/72, 84, 90, 114, 115, 117, 146
See application file for complete search history.

(56) References Cited

U.S. PATENT DOCUMENTS

| | | | | | |
|---|---|---|---|---|---|
| 1,907,164 | A | * | 5/1933 | White | 89/138 |
| 4,614,050 | A | | 9/1986 | Stevens | |
| 4,627,183 | A | * | 12/1986 | Stuckman | 42/1.01 |
| 4,733,489 | A | | 3/1988 | Kurak | |
| 4,845,871 | A | | 7/1989 | Swan | |
| 5,064,988 | A | * | 11/1991 | E'nama et al. | 219/121.6 |
| 5,142,806 | A | | 9/1992 | Swan | |
| 5,198,600 | A | | 3/1993 | E'Nama | |
| 5,237,773 | A | * | 8/1993 | Claridge | 42/117 |

(Continued)

OTHER PUBLICATIONS

Rianov Optical Ranging Device D06, Operator's Manual, ZRF, LLC, Nov. 10, 2010, pp. 1-26, www.rianov.com/manuals.html.

(Continued)

*Primary Examiner* — Gabriel Klein

(57) ABSTRACT

A rifle is provided. The rifle comprises a barrel, a handguard partly axially surrounding the barrel, and a modular accessory system. The modular accessory system comprises a housing and a modular accessory support system positioned within the housing, wherein the support system includes at least two modular accessory slots. The modular accessory system also comprises a modular accessory removably secured and individually adjustable within each slot. The housing partly axially surrounds the barrel and is positioned axially adjacent to the handguard such that a combination of the handguard and the housing surrounds the barrel completely in an axial manner. Support system configurations of preferably either tray-type or platform-type may be contemplated. The modular accessory system may further comprise a common power source and a display system. A modular accessory system for rifles capable of exchangeably mounting accessories thereto in plug-and-play fashion is therefore achieved.

20 Claims, 9 Drawing Sheets

(56) References Cited

U.S. PATENT DOCUMENTS

| | | | | |
|---|---|---|---|---|
| 5,343,650 | A | 9/1994 | Swan | |
| 5,345,707 | A | 9/1994 | Randall | |
| 5,531,040 | A | 7/1996 | Moore | |
| 5,581,898 | A | 12/1996 | Thummel | |
| 5,590,484 | A | 1/1997 | Mooney et al. | |
| 5,622,000 | A | 4/1997 | Marlowe | |
| 5,704,155 | A | 1/1998 | Primeau, IV | |
| 5,826,363 | A | 10/1998 | Olson | |
| 6,250,194 | B1 | 6/2001 | Brandl et al. | |
| 6,453,594 | B1 | 9/2002 | Griffin | |
| 6,618,976 | B1 | 9/2003 | Swan | |
| 6,705,038 | B2 | 3/2004 | Davenport et al. | |
| 6,785,997 | B2 | 9/2004 | Oz | |
| 7,117,624 | B2 | 10/2006 | Kim | |
| 7,117,625 | B2 | 10/2006 | Pikielny | |
| 7,191,557 | B2 | 3/2007 | Gablowski et al. | |
| 7,273,292 | B2 | 9/2007 | Kim | |
| 7,310,903 | B2 | 12/2007 | Kim | |
| 7,458,179 | B2 | 12/2008 | Swan | |
| 7,591,098 | B2 | 9/2009 | Matthews et al. | |
| 7,661,348 | B2 | 2/2010 | Murello | |
| 7,698,847 | B2 | 4/2010 | Griffin | |
| 7,726,061 | B1 | 6/2010 | Thummel | |
| 7,827,726 | B2 * | 11/2010 | Stokes | 42/146 |
| 7,954,273 | B1 | 6/2011 | Swan | |
| 8,001,715 | B2 | 8/2011 | Stokes | |
| 8,151,505 | B2 | 4/2012 | Thompson | |
| 8,201,353 | B1 | 6/2012 | Swan | |
| 8,256,153 | B1 | 9/2012 | Noha et al. | |
| 8,316,574 | B1 | 11/2012 | Swan | |
| 2003/0226305 | A1 | 12/2003 | Burnett | |
| 2004/0000083 | A1 | 1/2004 | Grant, Jr. | |
| 2004/0060222 | A1 * | 4/2004 | Oz | 42/146 |
| 2007/0074442 | A1 * | 4/2007 | Richeson | 42/132 |
| 2007/0199225 | A1 | 8/2007 | Haugen | |
| 2008/0060248 | A1 | 3/2008 | Pine et al. | |
| 2008/0301994 | A1 * | 12/2008 | Langevin et al. | 42/71.01 |
| 2009/0077855 | A1 | 3/2009 | Pritchett | |
| 2009/0122527 | A1 | 5/2009 | Galli | |
| 2009/0178325 | A1 | 7/2009 | Veilleux | |
| 2009/0219961 | A1 | 9/2009 | Meyers et al. | |
| 2010/0031552 | A1 | 2/2010 | Houde-Walter | |
| 2010/0180485 | A1 | 7/2010 | Cabahug et al. | |
| 2010/0192443 | A1 | 8/2010 | Cabahug et al. | |
| 2010/0192447 | A1 | 8/2010 | Cabahug et al. | |
| 2010/0218410 | A1 | 9/2010 | Cabahug et al. | |
| 2010/0275489 | A1 | 11/2010 | Cabahug et al. | |
| 2011/0061284 | A1 | 3/2011 | Cabahug et al. | |
| 2011/0255270 | A1 * | 10/2011 | Gross et al. | 362/110 |

OTHER PUBLICATIONS

Rianov Optical Ranging Device M06, Operator's Manual, ZRF, LLC, Nov. 10, 2010, pp. 1-26, www.rianov.com/manuals.html.

* cited by examiner

MODULAR ACCESSORY SYSTEM FOR RIFLE

RELATED APPLICATION(S)

This application is a continuation of U.S. patent application Ser. No. 13/207,389, filed Aug. 10, 2011, which is hereby incorporated herein by reference in its entirety.

FIELD OF THE INVENTION

The present invention relates generally to the field of rifles, and, more specifically, to modular accessory systems for rifles capable of exchangeably mounting accessories thereto in plug-and-play fashion.

BACKGROUND OF THE INVENTION

The continuing advancements of combat has led to a clear need for sophisticated weaponry with increased accuracy and multiple operational capabilities. With respect to rifles, particularly of the M4, M16, and AR-15 type, this need is reflected in the requirement that the rifle be able to support various accessories such as spotlight, floodlight, flashlight, targeting device, spotter, illuminator, night vision device, laser dazzler, rangefinder, etc., any of which may utilize visible light, infrared (IR) light, visible laser, IR laser, and electro-optical, etc. Consequently, conventional rifles have utilized various types of rifle mounts capable of holding the above-mentioned accessories. The following are various types of conventional accessory mounting techniques.

U.S. Pat. No. 4,845,871 sets forth a mount that is bolted to the top of the carrying handle of an M16.

U.S. Pat. No. 5,198,600 discloses a mount that clamps to the barrel of an M16. A rail-type connector including transverse slots allow the securing of a singular accessory.

U.S. Pat. No. 4,733,489 discloses a mount for a grenade launcher. The device attaches to the barrel of an M16 rifle and holds the launcher underneath the barrel. After attaching the device, the original hand guard is reattached.

It is also notoriously well-known that so-called Picatinny/Weaver/Swan rail (rail mount) systems, such as U.S. Pat. No. 4,845,871 mentioned above, have been widely employed to support single or multiple accessories.

The above conventional accessory mounting systems all suffer from various drawbacks. For example, the conventional accessory mount systems of rail-type employ designs which allow accessories to be attached anywhere on the rail. Therefore, there is no location commonality of the accessories when comparing one rifle to another, thereby increasing the learning curve. Also, since these accessories are positioned some distance away from each other and because each accessory is designed by various manufacturers typically with very angular and sharp portions, the potential for snagging along objects, people, buildings, becomes quite large. Another disadvantage of utilizing rail-type mounts is that the accessories mounted thereon are individually exposed and independently operable thereby requiring large protective shell housings, separate batteries and corresponding circuitry, all of which are costly and increases weight. Thus, if an entire accessory or one component within an accessory is non-functioning, the entire accessory (including the protective shell housing, separate battery, and corresponding circuitry) needs to be replaced at an increased cost. Yet another disadvantage occurs each time an accessory is replaced. Each accessory needs to be adjusted for sight alignment when attaching to these conventional mounts. As a further disadvantage, since each accessory is independently powered by a separate battery, each battery needs to be monitored. Since the accessories are likely to consume power at different amounts and times and since accessories and their corresponding batteries are themselves likely to be replaced at different times, determining the charge remaining for all the various batteries will be a constant struggle.

Thus, it is desirable to provide a rifle comprising a modular accessory system which is able to overcome the above disadvantages.

Therefore, a need exists for a modular accessory system that easily attaches to a rifle, houses a plurality of accessories simultaneously, allows for exchangeably mounting accessories in plug-and-play fashion, eliminates the need to replace an entire assembly if one accessory is non-functioning, allows for adjustability of the modular accessories, reduce or eliminate the need to calibrate when replacing accessories, powers a plurality of accessories simultaneously, reduces learning curve, consolidates controller interface, increases up-time and time to achieve combat-ready state, minimizes weight, minimizes cost, and has a streamlined housing.

These and other advantages of the present invention will become more fully apparent from the detailed description of the invention hereinbelow.

SUMMARY OF THE INVENTION

The present invention is directed to a rifle comprising a barrel, a handguard partly axially surrounding the barrel, and a modular accessory system. The modular accessory system comprises a housing and a modular accessory support system positioned within the housing, wherein the support system includes at least two modular accessory slots. The modular accessory system also comprises a modular accessory removably secured within each slot, wherein each accessory is individually adjustable in a first axis and a second axis while being removably secured within each slot, and wherein the first axis is perpendicular from the second axis. The housing partly axially surrounds the barrel and is positioned axially adjacent to the handguard such that a combination of the handguard and the housing surrounds the barrel completely in an axial manner. The handguard and the housing are preferably removably secured to the rifle via a Delta-ring type connector. In one embodiment, the accessories are accessible via an opening within the housing that is exposed upon separation of the housing from the rifle.

In an alternative embodiment, the housing includes a door that is movable between an open position and a closed position, wherein the accessories are accessible via an opening within the housing that is exposed when the door is in the open position.

In another alternative embodiment, the accessories are accessible via a front surface of the housing. The housing may include a front cover that is movable between an open position and a closed position, wherein the accessories are accessible via a front surface of the housing that is exposed when the front cover is in the open position.

Various support system configurations of preferably either tray-type or platform-type may be contemplated as described below. The modular accessory system may further comprise a common power source electrically connected to each accessory while each accessory is removably secured within each slot, wherein each accessory is powered by the common power source.

The modular accessory system may further comprise a display system which includes a display, wherein the display system is communicatively connected to each accessory while each accessory is removably secured within each slot, wherein data corresponding to each accessory is received by the display system, and wherein information corresponding to the data is displayed on the display.

BRIEF DESCRIPTION OF THE DRAWINGS

For the present invention to be clearly understood and readily practiced, the present invention will be described in conjunction with the following figures, wherein.

DETAILED DESCRIPTION OF THE PREFERRED EMBODIMENTS

Figure 1:
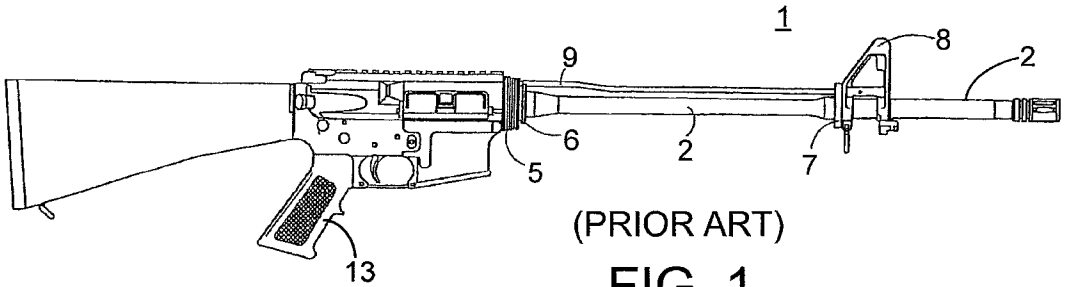
(PRIOR ART) FIG. 1
FIG. 1 is a side view of a prior art rifle with no handguards nor rail system installed.

It is to be understood that the figures and descriptions of the present invention may have been simplified to illustrate elements that are relevant for a clear understanding of the present invention, while eliminating, for purposes of clarity, other elements found in a typical rifle. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

Figure 6:
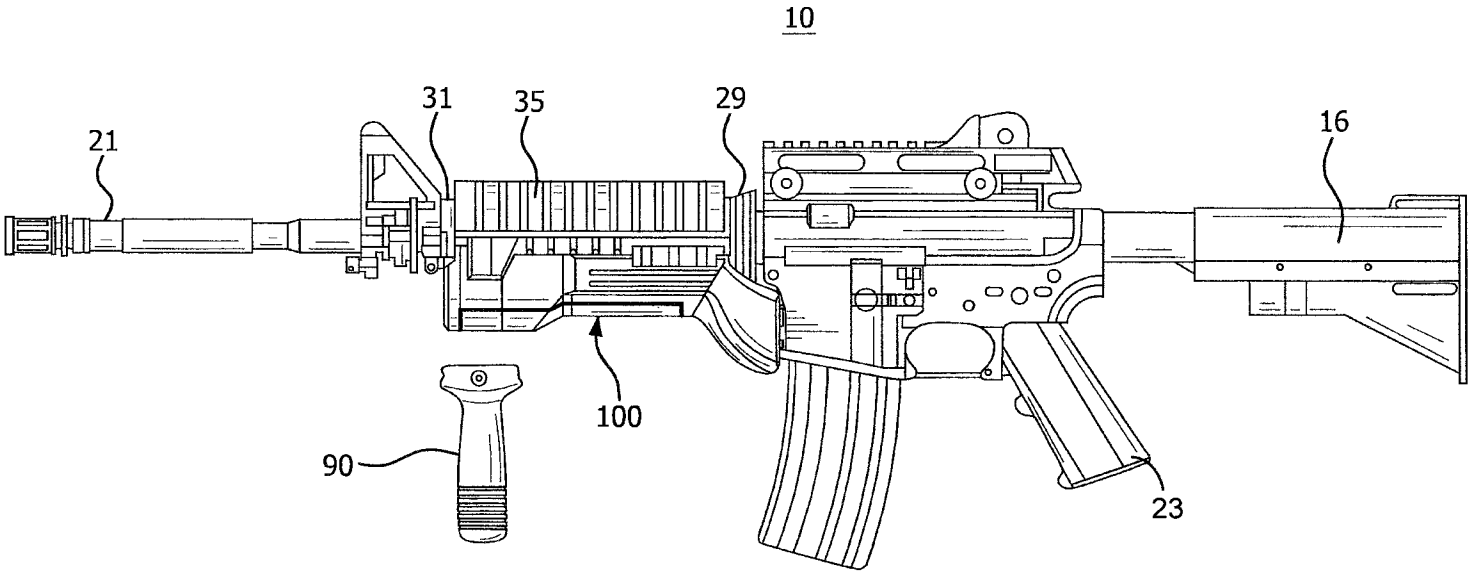
FIG. 6 is a side view of a rifle that includes an exemplary modular accessory system, in accordance with a preferred embodiment of the present invention.

For purposes of this disclosure, the term "handguard" is hereby defined as any element that partly axially surrounds a barrel (see, for example, barrel 21 in FIG. 6) and is to be held in place between fasteners such as Delta-ring 29 and cap 31 (see, for example, handguard 35 in FIG. 6). As an alternative to the type of handguard 35 shown in FIG. 6, the handguard may alternatively comprise a rail mounting system (e.g. Picatinny, Weaver, Swan rail systems). As another alternative, the handguard may comprise a combination of the type of handguard 35 shown in FIG. 6 with a rail mounting system.

FIG. 1 is a side view of a prior art rifle 1 with no handguards nor rail system installed. FIG. 1 also illustrates a handgrip 13, a barrel 2, a front sight assembly 8, and a gas tube 9.

Figure 2:
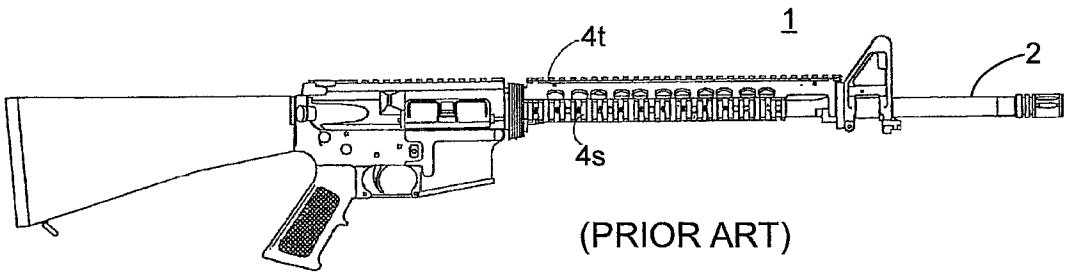
(PRIOR ART) FIG. 2
FIG. 2 is a side view of a prior art rifle with a top rail and a side rail of a traditional quad-rail system installed.

FIG. 2 is a side view of a prior art rifle 1 with a top rail 4*t* and a side rail 4*s* of a traditional quad-rail system installed.

Figure 3:
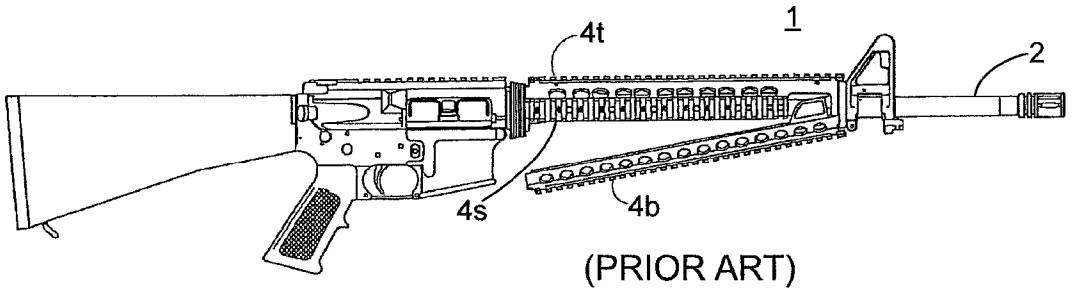
(PRIOR ART) FIG. 3
FIG. 3 is a side view of a prior art rifle with a top rail and a side rail of a traditional quad-rail system installed, and a bottom rail of the traditional quad-rail system being installed or being removed.

FIG. 3 is a side view of a prior art rifle 1 with a top rail 4*t* and a side rail 4*s* of a traditional quad-rail system installed, and a bottom rail 4*b* of the traditional quad-rail system being installed or being removed.

Figure 4:
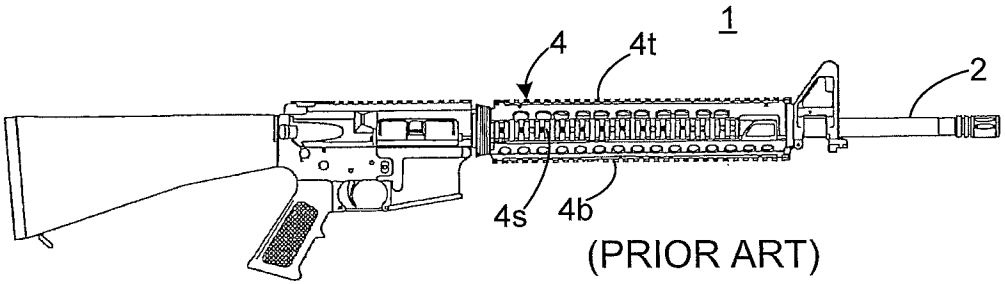
(PRIOR ART) FIG. 4
FIG. 4 is a side view of a prior art rifle with a top rail, a side rail, and a bottom rail of a traditional quad-rail system installed.

FIG. 4 is a side view of a prior art rifle 1 with a top rail 4*t*, a side rail 4*s*, and a bottom rail 4*b* of a traditional quad-rail system 4 installed.

Figure 5:
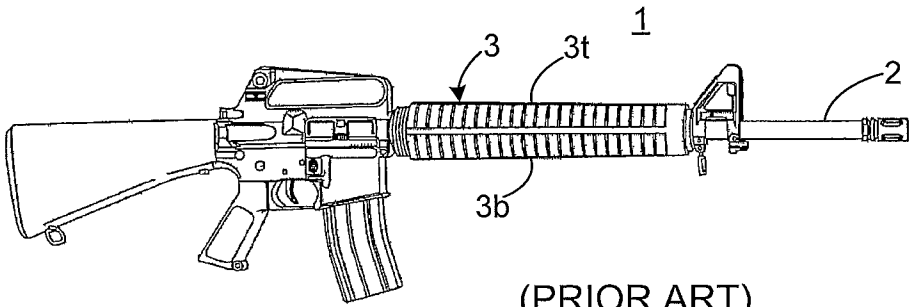
(PRIOR ART) FIG. 5
FIG. 5 is a side view of a prior art rifle including a traditional handguard system including a top handguard and a bottom handguard.

FIG. 5 is a side view of a prior art rifle 1 comprising a traditional handguard system 3 including a top handguard 3*t* and a bottom handguard 3*b*.

FIG. 6 is a side view of a rifle 10 that includes an exemplary modular accessory system (MAS) 100, in accordance with a preferred embodiment of the present invention. Rifle 10 may preferably be of the M4, M16, and AR-15 type, but other rifles may benefit from the MAS of the present invention. FIG. 6 also illustrates a handgrip 23, a barrel 21 and a buttstock 16. A handguard 35 is shown at the top side of the rifle 10. A Delta-ring 29 is preferably utilized to removably attach the handguard 35 to the rifle 10. The rear side of the handguard 35 is held in place via the Delta-ring 29 while the front side of the handguard is held in place via a cap 31 provided on barrel 21. The handguard 35 is provided with a front collar 36 and a rear collar 38 (see FIGS. 7-10). The front collar 36 is captured and retained in cap 31, and the rear collar 38 is captured and retained in the Delta-ring 29. The handguard 35, Delta-ring 29, cap 31, front collar 36, rear collar 38, and their operability with other corresponding components in removably attaching the handguard 35 to the rifle 10, are generally known to those skilled in the rifle art and may be the type as described in more detail (with like numerals) in U.S. Pat. No. 5,198,600. Note FIG. 3 of the present invention shows a handguard of rail mount type as its bottom rail 4*b* is being installed, which would be a similar process as the installation of the handguard 35 shown in the present invention and in U.S. Pat. No. 5,198,600.

A grip 90 may optionally be employed as also illustrated in FIG. 6. Any attachment system may be utilized to attach the grip 90 to the MAS 100. Such attachment system is considered to be within the knowledge of one skilled in the rifle-grip field. A rail mount may even be contemplated for the bottom side (104, FIG. 7) of the housing of the MAS 100. The grip 90 may utilize such a rail for attachment to the bottom side 104 of the housing of the MAS 100. The rail may even mount additional non-modular accessories if desired. See U.S. Pat. No. 7,191,557 which discloses a bottom rail for attaching a grip. The grip/rail configuration may alternatively be employed on either or both of the left/right sides (108, FIG. 7) of the housing of the MAS 100.

Figure 7:
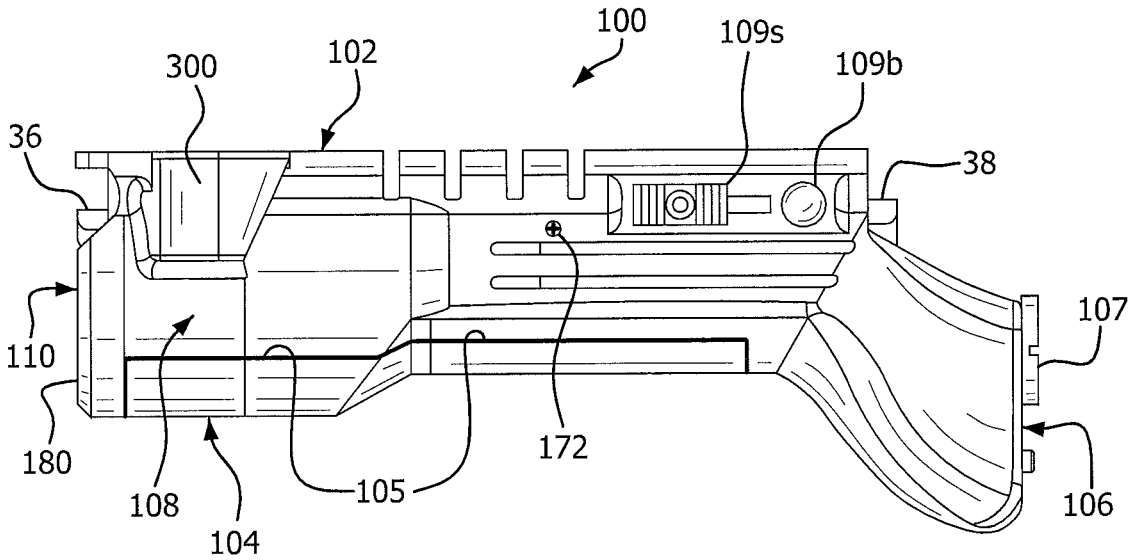
FIG. 7 is a side view of the exemplary modular accessory system shown in FIG. 6.
Figure 8:
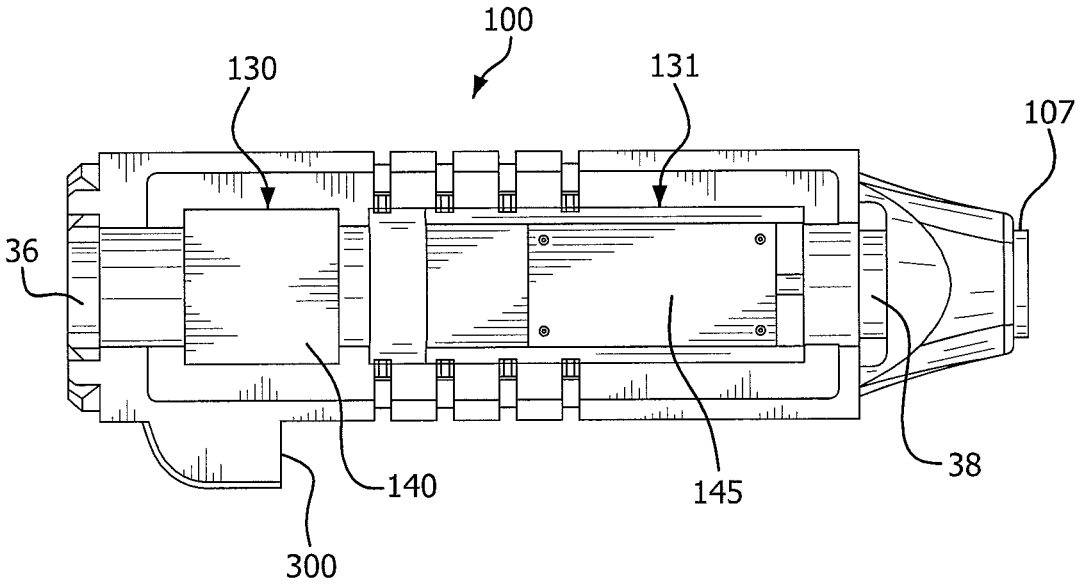
FIG. 8 is a plan view of the exemplary modular accessory system shown in FIG. 6.
Figure 9:
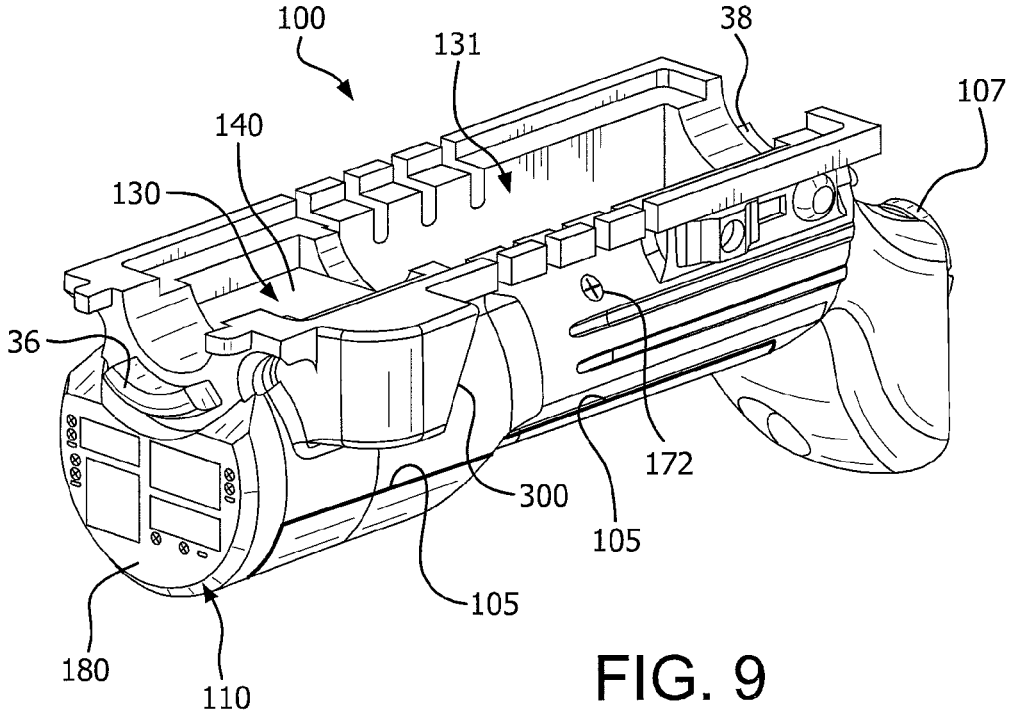
FIG. 9 is an isometric view of the exemplary modular accessory system shown in FIG. 6.
Figure 10:
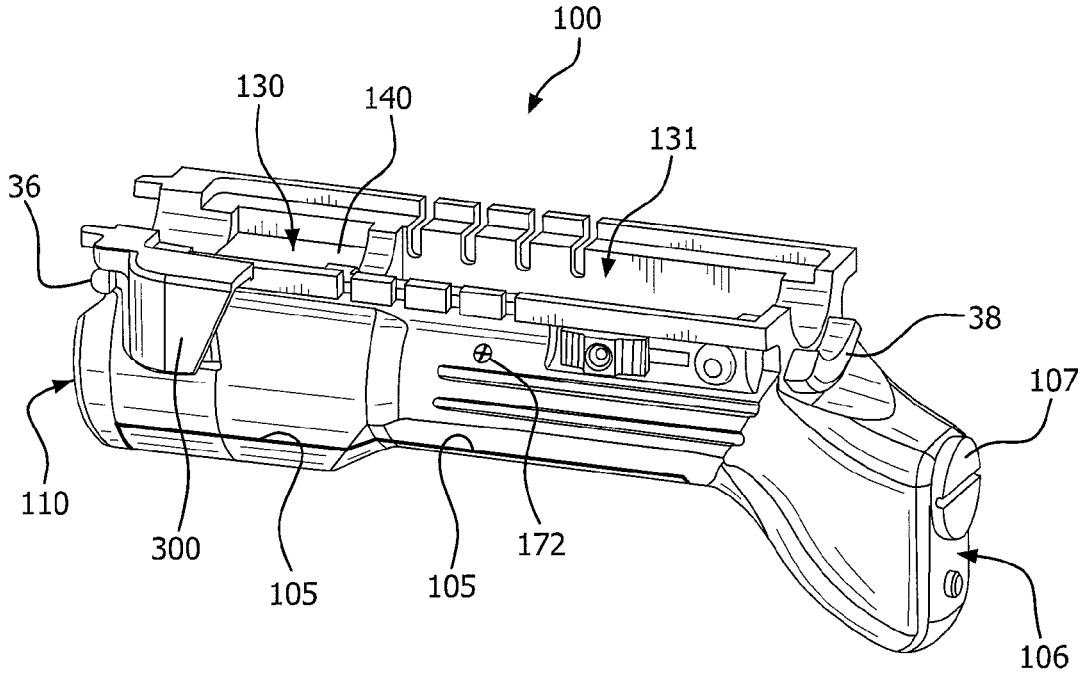
FIG. 10 is another isometric view of the exemplary modular accessory system shown in FIG. 6.
Figure 11:
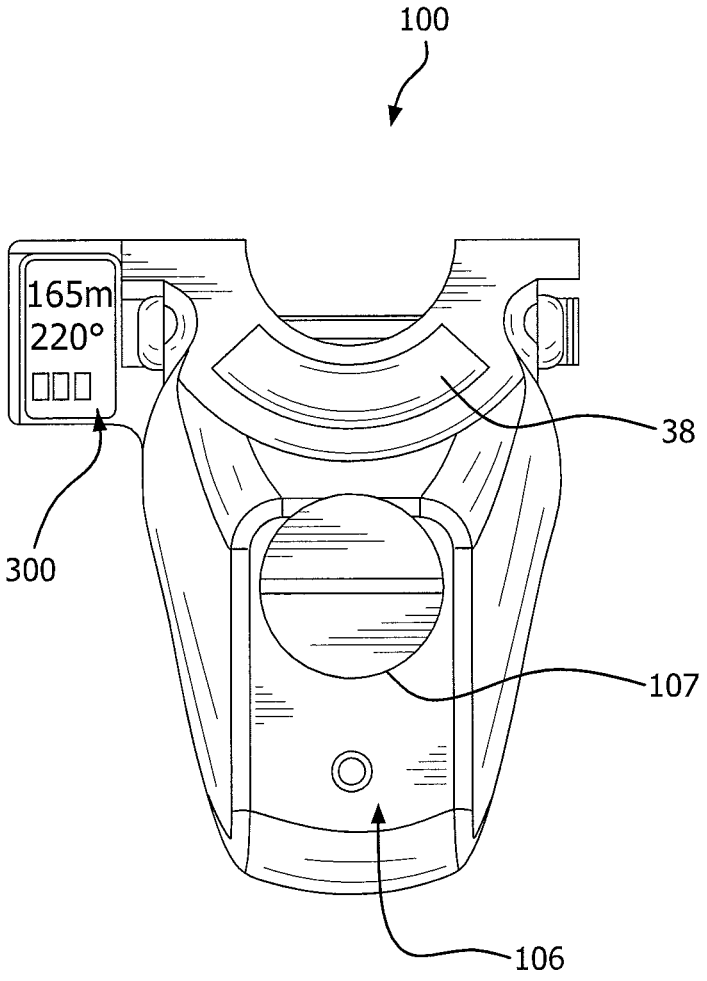
FIG. 11 is a rear view of the exemplary modular accessory system shown in FIG. 6.
Figure 12:
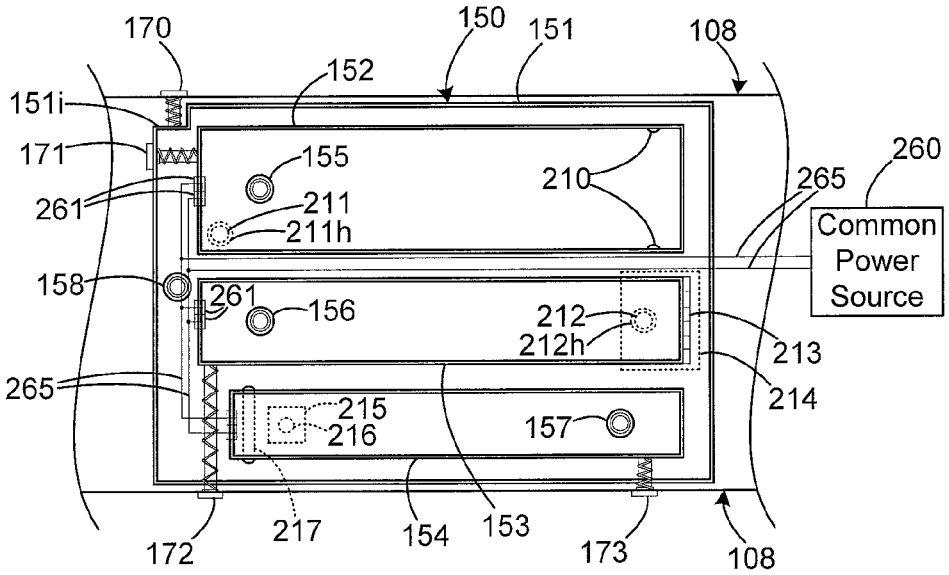
FIG. 12 is a plan view of an exemplary support system including a tray containing holders that support modular accessories in plug-and-play fashion, in accordance with a preferred embodiment of the present invention.
Figure 13:
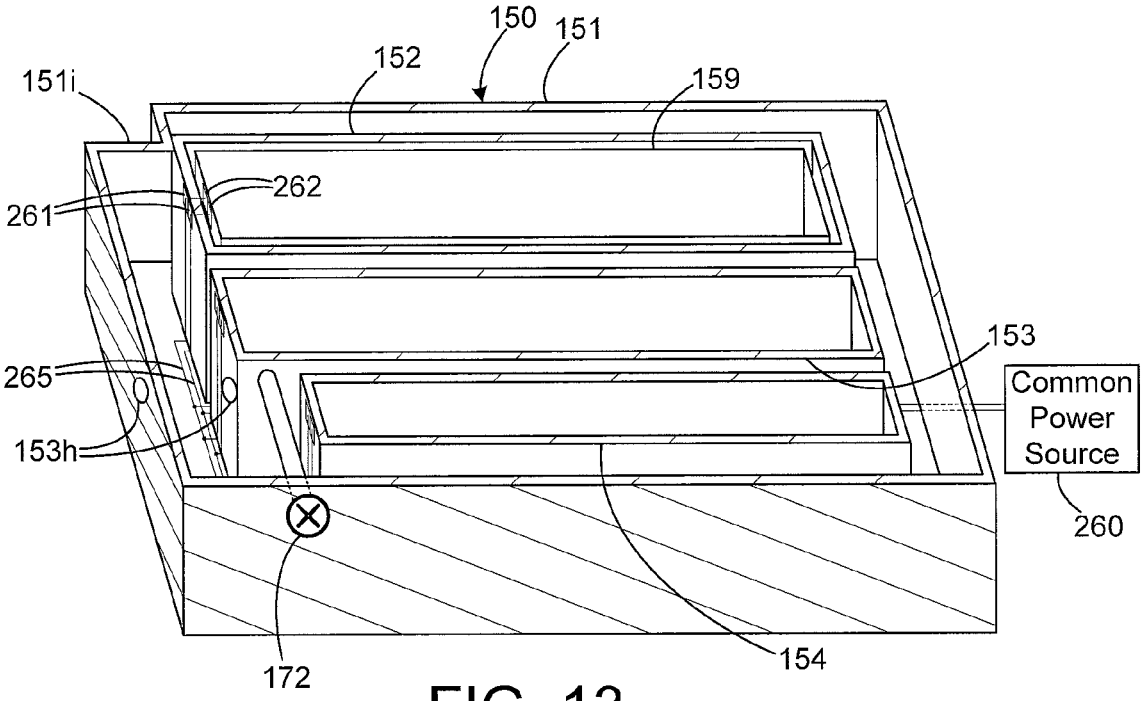
FIG. 13 is an isometric view of the exemplary support system shown in FIG. 12.

FIGS. 7-9 are a side view, a plan view, and an isometric view, respectively, of the exemplary MAS 100 shown in FIG. 6. FIG. 10 is another isometric view of the exemplary MAS 100 shown in FIG. 6. FIG. 11 is a rear view of the exemplary MAS 100 shown in FIG. 6. FIG. 7 illustrates the exemplary MAS 100 comprising a housing having a top side 102, a bottom side 104, a rear side 106, left/right sides 108, and a front side 110. A front surface 180 of the housing is provided at front side 110. A battery cap 107 may preferably be screw-type and may be provided at the rear side 106. A common power source 260 (e.g. a battery or fuel cell of any type—as schematically shown in FIGS. 12 and 13) may be housed in a compartment within the housing located at the rear side 106 or located at the rear side of the buttstock 16. In either location, the common power source may be accessible via battery cap 107. Batteries of conventional type (e.g. AAA-type, AA-type, lithium-type, etc.) and other/non-conventional type batteries may be employed and can easily be replaced since they are widely available throughout the world. Note that the common power source of the present invention may comprise more than one battery and/or fuel cell for extended operating range of power. The common power source is electrically connected to each modular accessory while each modular accessory is removably secured within each slot. This common power source configuration significantly increases efficiency and results in an overall reduction in battery consumption as it overcomes the disadvantages of using separate/independent batteries for each accessory, as mentioned in the "Background of the Invention" section above.

Controls such as slider switch 109*s* or button 109*b* may be employed to control some or all of the modular accessories. The controls may be located elsewhere such as on front side 110, bottom side 104, at the rear side of the buttstock 16, or at another location on the left/right side 108.

FIGS. 8-10 illustrate front compartment 130 and rear compartment 131. One or both of these compartments may house a modular accessory support system 150, 160 as explained more fully below with reference to FIGS. 12-15. Front compartment 130 may also house an optics insulator block 140 while rear compartment 131 may house a motherboard assembly 145. Alternatively, rear compartment 131 may house an optics insulator block 140 while front compartment 130 may house a motherboard assembly 145. As another alternative, the optics insulator block 140 and/or motherboard assembly 145 may be omitted, provided elsewhere within the rifle, or may both be located in one of the front/rear compartments 130, 131. An optics connector board is optional and may also be utilized in either or both of the front/rear compartments 130, 131. The optics insulator block 140 is optional and may be provided to isolate modular accessory optical paths from each other. As another alternative configuration, front compartment 130 and rear compartment 131 may be replaced by a single compartment (not shown).

FIG. 12 is a plan view of an exemplary support system 150 including a tray 151 containing holders 152, 153, 154 that define at least two slots that support modular accessories (e.g. modular accessory 200 in FIG. 23) in plug-and-play fashion, in accordance with a preferred embodiment of the present invention. It is noted that FIGS. 12-15 do not illustrate the modular accessories as being inserted in the slots. Modular accessory 200 will be inserted into holder 152 such that indentations 210*i* (again, see FIG. 23) of the modular accessory 200 mate with protrusions 210 within holder 152. Protrusions 210 may be, for example, spring-biased ball plungers. It is noted that modular accessory 200 may alternatively have protrusions while the holder 152 provides the corresponding indentations. A rotation axle defined by the mating of the indentations 210*i* and protrusions 210 serves as a pivoting axis which allows for pivoting (i.e. adjustment) of the modular accessory 200 in a vertical direction (i.e. z-axis) upon actuation of a z-axis adjustment device. The z-axis adjustment device may be, for example, z-axis adjustment screw 155 which is positioned at an opposite end of the holder 152 of the modular accessory 200 from that of the indentations 210*i* and protrusions 210. Screw 155 is vertically positioned either above or below the holder 152 or modular accessory 200 such that rotation of screw 155 causes vertical movement of the corresponding end of the modular accessory 200 via the holder 152. The positioning of the screw 155 may depend on whether access to the interior of the housing is achieved from the top side 102 or the bottom side 104 via door 105 which is shown in FIGS. 7, 9, and 10. Either the modular accessory 200, holder 152, or the screw 155 may optionally be spring-biased. There may optionally be a pivot point or axis along the modular accessory 200 or holder 152 between the indentations/protrusions and the screw 155 to facilitate the z-axis pivoting of the modular accessory 200. Other adjustment devices may of course be contemplated and are considered to be within the scope of the present invention. As an alternative to the indentations 210*i* and protrusions 210, FIG. 12 illustrates the use of a hinge 213 for vertical adjustment of the modular accessory 200 within holder 153. Plate 214 may optionally be employed to attach hinge 213 to holder 153 or to tray 151. Holder 154 may be sized larger than the modular accessory 200 such that a space is provided at one end of the holder 154 for placement of a roller axle 217 which functions to raise the holder itself in a vertical direction thereby raising the modular accessory 200 when removably secured therein. The adjustment devices for holders 153, 154 may comprise screws 156, 157 identical to that of screw 155. Other types of adjustment devices that function similarly to thereby enable vertical adjustability of the modular accessory 200 may be contemplated and are considered to be within the scope of the present invention. It is noted that the tray/holders are shown with openings at their top sides for access to the tray/holders/modular accessories/screws 155, 156, 157 from above via an opening within the housing that is exposed upon separation of the housing from the rifle. Alternatively, the tray/holders may instead employ openings at their bottom sides for access to the tray/holders/modular accessories/screws 155, 156, 157 from below via an opening within the housing that is exposed when the door 105 is in the open position. Alternatively, the screws 155, 156, 157 may alternatively directly adjust the modular accessories themselves instead of their corresponding holders or sleeves.

X-direction adjustment devices may be employed to effect pivoting (i.e. adjustment) of the holders 152, 153, 154, respectively, in a horizontal direction (i.e. x-axis). These x-direction adjustment devices for holders 152, 153, 154 may comprise x-axis adjustment screws 171, 172, 173 identical to that of screws 155, 156, 157 above. Other types of adjustment devices that function similarly to thereby enable horizontal adjustability of the modular accessory 200 may be contemplated and are considered to be within the scope of the present invention. Screw 171 is positioned to abut against a front portion of holder 152 and may extend through the tray 151 for accessing purposes. Alternatively, screw 174 (see FIGS. 16-22) may be utilized in place of screw 171 and may function similarly to screw 171. However, screw 174 differs from screw 171 in that it extends to the front side 110 of MAS 100. Note: screw 174 is not labeled in FIG. 20-22 for simplicity purposes. A rotation axle 211 provided optionally through hole 211*h* in holder 152 serves as a pivoting axis which allows for pivoting (i.e. adjustment) of the modular accessory 200 in a horizontal direction (i.e. x-axis) upon actuation of screw 171 (or screw 174). Screw 172 is positioned to abut against a side portion of holder 153 and may extend through the left side 108 of MAS 100 for accessing purposes. Holder 153 pivots about rotation axle 212 upon turning of the screw 172. The rotation axle 212 may be provided optionally through hole 212*h*. Rotation axle 212 may optionally be affixed to plate 214 which may be affixed to tray 151. Note that screw 172 is also shown in FIGS. 7, 9, and 10.

Screw 173 is positioned to abut against a side portion of holder 154 and may extend through the left side 108 of MAS 100 for accessing purposes. Holder 154 pivots about rotation axle 216 upon turning of the screw 173. The rotation axle 216 may optionally be affixed to plate 215 which may be affixed to tray 151.

Screw 170 is positioned to abut against a notch 151*i* within tray 151 and may extend through the right side 108 of MAS 100 for accessing purposes. The effect of turning screw 170 differs from that of screws 171, 172, 173 in that adjustment of the entire tray 151 in the x-direction is achieved. This results in a common adjustment of trays 152, 153, 154 thereby effecting adjustment of the modular accessories in a combined manner in the x-direction. A corresponding pivoting axis may be employed similar to those of the holders but is not shown for simplicity purposes.

Screw 158 functions similarly to screws 155, 156, 157. The effect of turning screw 158 differs from that of screws 155, 156, 157 in that adjustment of the entire tray 151 in the z-direction is achieved. This results in a common adjustment of trays 152, 153, 154 thereby effecting adjustment of the modular accessories in a combined manner in the z-direction. A corresponding pivoting axis may be employed similar to those of the holders but is not shown for simplicity purposes.

FIG. 13 is an isometric view of the exemplary support system 150 shown in FIG. 12. For simplicity purposes, some elements in FIG. 12 (e.g. all the adjustment screws except for adjustment screw 172) are not illustrated in FIG. 13. FIG. 13 shows the use of a sleeve 159 which may optionally be employed. A modular accessory 200 may utilize sleeve 159 for a variety of purposes. As an example, a modular accessory 200 may reduce it's complexity by transferring some components (e.g. circuitry) to sleeve 159. Sleeve 159 may also serve to protect a modular accessory from the environment. Further, sleeve 159 may reduce or eliminate vibrations to the modular accessory occurring both prior to the securing of the modular accessory within the holder and when the modular accessory is secured within the holder. Note: FIG. 13 shows the optional sleeve 159 whereas FIG. 12 does not show sleeve 159 as being employed.

The modular accessory 200 employs electrical contact pads 263 which are electrically connected to contact pads 261. Common power source 260 is electrically connected to contact pads 261 via electrical wiring 265. Other wiring and/or electrical contact connections and configurations may be alternatively employed and are considered to be within the scope of the present invention. In the embodiment where sleeve 159 is utilized, contact pads 263 are electrically connected to contact pads 261 via contact pads 262 (FIG. 13).

When modular accessories are removably secured within the holders, holes 153*h* (or, alternatively, windows) are provided within each holder and tray 151 to allow the signals/light to be transmitted and received by the modular accessories. FIG. 13 illustrates these holes 153*h*. Holes 153*h* are omitted from FIG. 12 for simplicity purposes. The remaining holders and any sleeves would employ similar holes/windows.

Figure 14:
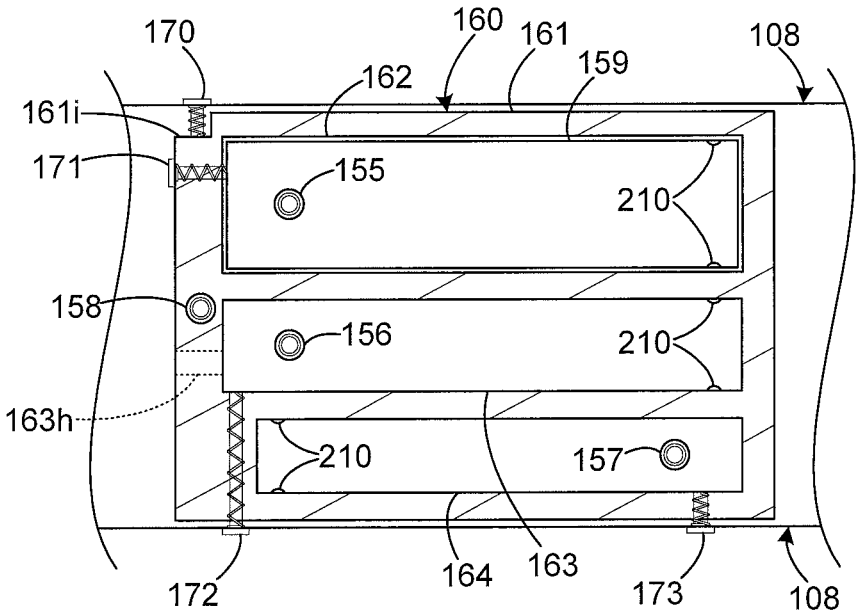
FIG. 14 is a plan view of an exemplary support system including a slotted platform that supports modular accessories in plug-and-play fashion, in accordance with a preferred embodiment of the present invention.

FIG. 14 is a plan view of an exemplary support system 160 including a slotted platform 161 that supports modular accessories (e.g. modular accessory 200 in FIG. 23) in plug-and-play fashion, in accordance with a preferred embodiment of the present invention.

Figure 15:
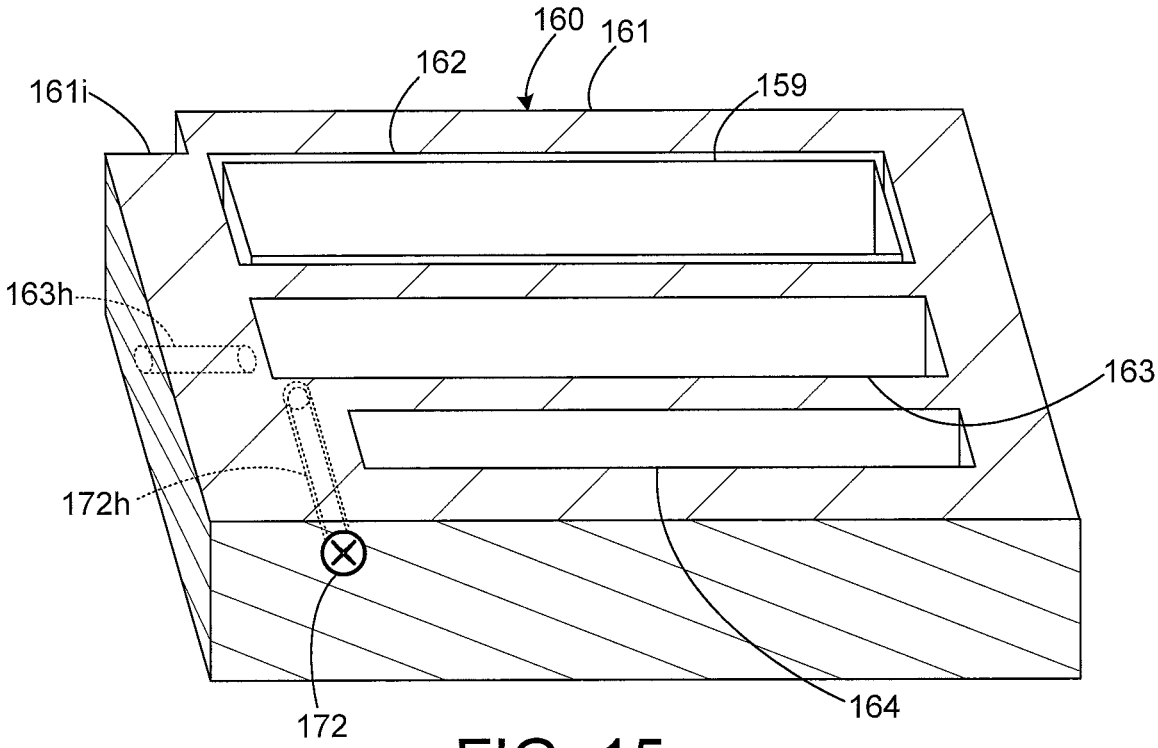
FIG. 15 is an isometric view of the exemplary support system shown in FIG. 14.

Support system 160 in FIGS. 14 and 15 differs from support system 150 in FIGS. 12 and 13 in several ways. Platform 161 is employed instead of tray 151. Platform 161 includes slots 162, 163, 164 which are utilized to removably secure modular accessories therein. Protrusions 210 are utilized in each of slots 162, 163, 164. Optional sleeve 159 is now shown in FIG. 14 whereas it was omitted in FIG. 12 as mentioned above. Screws 172, 173 now abut directly against the modular accessories themselves instead of their holders. However, screw 171 abuts against sleeve 159. Since platform 161 is solid, hole 163*h* (or a window) must be provided horizontally from slot 163 through the front portion of platform 161. Hole 163*h* is otherwise functionally similar to hole 153*h* in that it allows the signals/light to be transmitted and received by the modular accessories. The remaining slots and any sleeves would employ similar holes/windows. Screw 170 abuts notch 161*i* within platform 161 and functions similarly to screw 170 that abuts notch 151*i* within tray 151 in FIGS. 12 and 13. Adjustment of the modular accessories in a combined manner in the x-direction is thereby achieved.

FIG. 15 is an isometric view of the exemplary support system 160 shown in FIG. 14. For simplicity purposes, some elements in FIG. 14 (e.g. all the adjustment screws except for adjustment screw 172) are not illustrated in FIG. 15. Screw 172 resides within hole 172*h* which is provided within platform 161.

Figure 16:
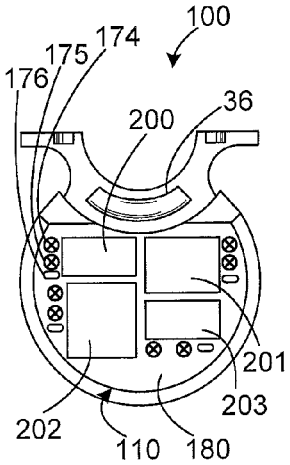
FIG. 16 is a partial front view of the exemplary modular accessory system shown in FIG. 9 employing four modular accessories of varying rectangular sizes, in accordance with a preferred embodiment of the present invention.

FIG. 16 is a partial front view of the exemplary MAS 100 shown in FIG. 9 employing four modular accessories 200, 201, 202, 203 of varying rectangular sizes which are viewable and accessible via front surface 180 at front side 110 of MAS 100, in accordance with a preferred embodiment of the present invention. Each modular accessory has adjustment screws 174, 175 for adjustment of the modular accessories in the x and z directions, respectively. Optionally, removal of modular accessory 200 may be performed upon actuation of button 176. Button 176 may utilize a removal mechanism (e.g. a lever) which pushes the modular accessory out of its corresponding holder/slot. Another exemplary removal mechanism which may be employed is a pull tab provided on a front side of the modular accessory (not shown in FIG. 16). The optional sleeve may be removed along with the modular accessory upon actuation of the button 176 or, the pull tab may be employed on the sleeve itself.

Figure 17:
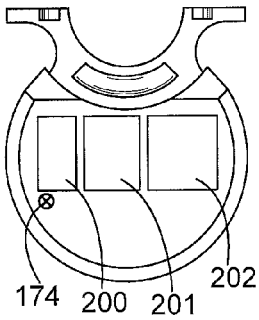
FIG. 17 is a partial front view of an exemplary modular accessory system employing three modular accessories of varying rectangular sizes, in accordance with a preferred embodiment of the present invention.

FIG. 17 is a partial front view of an exemplary MAS 100 employing three modular accessories 200, 201, 202 of varying rectangular sizes, in accordance with a preferred embodiment of the present invention. In this configuration, only one screw 174 is employed.

Figure 18:
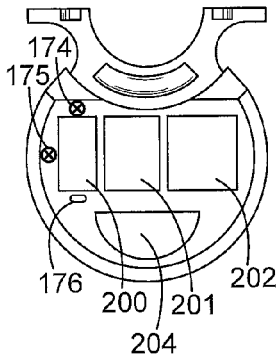
FIG. 18 is a partial front view of an exemplary modular accessory system employing four modular accessories of varying sizes and shapes, in accordance with a preferred embodiment of the present invention.

FIG. 18 is a partial front view of an exemplary MAS 100 employing four modular accessories 200, 201, 202, 204 of varying sizes and shapes, in accordance with a preferred embodiment of the present invention. Modular accessory 204 is shown having a hemispherical cross-section. Screws 174 and 175 are shown at different locations but otherwise function similarly.

Figure 19:
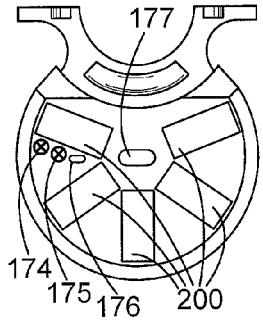
FIG. 19 is a partial front view of an exemplary modular accessory system employing five modular accessories distributed in a circular pattern, in accordance with a preferred embodiment of the present invention.

FIG. 19 is a partial front view of an exemplary MAS 100 employing five modular accessories 200 distributed in a circular pattern, in accordance with a preferred embodiment of the present invention. Master button 177 is provided in addition to button 176. Master button 177 differs from button 176 in that removal of all modular accessories occurs simultaneously upon actuation of master button 177.

Figure 20:
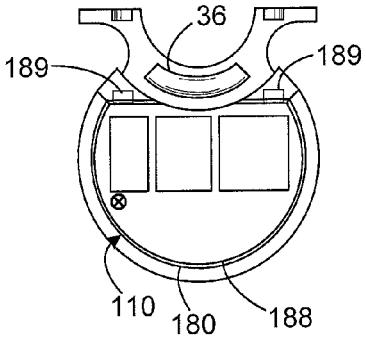
FIG. 20 is a partial front view of the exemplary modular accessory system as shown in FIG. 17 employing a front cover for accessing (e.g. inserting, viewing, adjusting, or removing) the modular accessories, in accordance with a preferred embodiment of the present invention.
Figure 21:
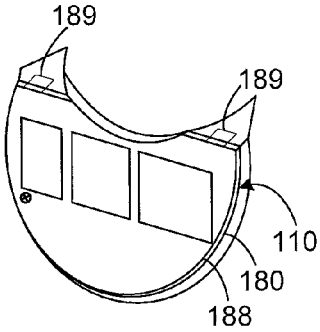
FIG. 21 is a partial isometric view of the front surface of the exemplary modular accessory system as shown in FIG. 20.
Figure 22:
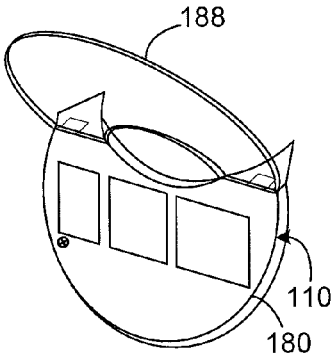
FIG. 22 is a partial isometric view of the front surface of the exemplary modular accessory system as shown in FIG. 20 illustrating the front cover in a raised/open position.

FIG. 20 is a partial front view of the exemplary MAS 100 as shown in FIG. 17 employing a front cover 188 for accessing (e.g. inserting, viewing, adjusting, or removing) the modular accessories, in accordance with a preferred embodiment of the present invention. The front cover 188 is preferably a clear material (e.g. plastic, glass, polymer, or combinations thereof), and provides a ruggedized window for viewing the modular accessories. The front cover 188 may be replaceable and may have different optical coatings thereon. The coatings may comprise, for example, anti-reflection coating, anti-glare coating, a coating to adjust/change the IR laser's visibility spectrum, etc. Hinges 189 may be employed to allow for the raising/lowering of the front cover 188 as illustrated in FIG. 22. FIG. 21 is a partial isometric view of the front side 110 of the exemplary MAS 100 as shown in FIG. 20. FIG. 22 is a similar partial isometric view of the front side 110 of the exemplary MAS 100 as shown in FIG. 20 illustrating the front cover 188 in a raised/open position.

Figure 23:
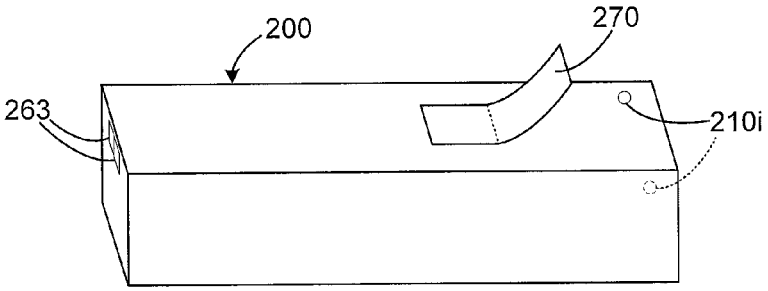
FIG. 23 is an isometric view of an exemplary modular accessory, in accordance with a preferred embodiment of the present invention.

FIG. 23 is an isometric view of an exemplary modular accessory 200, in accordance with a preferred embodiment of the present invention. The modular accessory 200 may be any or a combination of the following: spotlight, floodlight, flashlight, targeting device, spotter, illuminator, night vision device, laser dazzler, rangefinder, combinations thereof, etc., any of which may utilize visible light, infrared (IR) light, visible laser, IR laser, electro-optical, combinations thereof, etc. Modular accessory 200 may employ indentations 210*i* and/or a pull tab 270 as mentioned above. Pull tab 270 is shown on top of the modular accessory. This configuration may be utilized when access to the interior of the housing is achieved from above. Pull tab 270 may be provided on the bottom of the modular accessory when access to the interior of the housing is achieved from below via door 105 as shown in FIGS. 7, 9, and 10. The pull tab 270 may be utilized in the embodiments of FIGS. 12-15 in order to remove modular accessory 200 from holders or slots of the corresponding support system. The optional sleeve may be removed along with the modular accessory upon pulling of the pull tab.270, or the pull tab may be employed on the sleeve itself for removal of both the sleeve and modular accessory together. The description and use of modular accessory 200 mentioned above may also be applicable to other types of modular accessories such as modular accessories 201-204, etc.

The present invention is directed to a rifle 10 comprising a barrel 21, a handguard 35 partly axially surrounding the barrel 21, and a MAS 100. The MAS 100 comprises a housing and a modular accessory support system 150, 160 positioned within the housing, wherein the support system 150, 160 includes at least two modular accessory slots. The MAS 100 also comprises a modular accessory 200-204 removably secured within each slot, wherein each accessory is individually adjustable in a first axis and a second axis while being removably secured within each slot, and wherein the first axis is perpendicular from the second axis. The housing partly axially surrounds the barrel 21 and is positioned axially adjacent to the handguard 35 such that a combination of the handguard 35 and the housing surrounds the barrel 21 completely in an axial manner. The handguard and the housing are preferably removably secured to the rifle via a Delta-ring type connector 29. In one embodiment, the accessories are accessible via an opening 130, 131 within the housing that is exposed upon separation of the housing from the rifle. In this configuration, the opening is located at a top side 102 of the housing.

In an alternative embodiment, the housing includes a door 105 that is movable between an open position and a closed position, wherein the accessories are accessible via an opening within the housing that is exposed when the door 105 is in the open position. In this configuration, the door is located at a bottom side 104 of the housing.

In another alternative embodiment, the accessories are accessible via a front surface 180 of the housing. Alternatively, the housing may include a front cover 188 that is movable between an open position and a closed position, wherein the accessories are accessible via a front surface 180 of the housing that is exposed when the front cover 188 is in the open position.

The support system may comprise a tray 150 that contains holders 152, 153, 154 that define the at least two slots, wherein the individual adjustability of each accessory is achieved via adjustment of a corresponding one of the holders 152, 153, 154. The tray 150 is preferably adjustable in a third axis and a fourth axis thereby effecting adjustment of the accessories in a combined manner, wherein the third axis is perpendicular from the fourth axis. In this tray-type configuration, it is noted that the third axis and fourth axis may be the same or different than the first axis and second axis, respectively, mentioned above.

The support system may alternatively comprise a platform 160 that includes the at least two slots 162, 163, 164. The platform 160 is preferably adjustable in a third axis and a fourth axis thereby effecting adjustment of the accessories in a combined manner, wherein the third axis is perpendicular from the fourth axis. In this platform-type configuration, it is noted that the third axis and fourth axis may be the same or different than the first axis and second axis, respectively, mentioned above.

The MAS 100 may further comprise a common power source 260 electrically connected to each accessory while each accessory is removably secured within each slot, wherein each accessory is powered by the common power source 260. The power source 260 may be positioned within the housing, within a buttstock 16 of the rifle 10, or within the grip 90. In the configuration where the power source 260 is positioned within the grip 90, grip 90 would be a conductive grip and would be electrically connected to bottom side 104 of the MAS 100 through electrical connections/contacts. If utilizing a mounting rail on the bottom side 104 of the housing of the MAS 100 for attaching the grip 90, the mounting rail may preferably be a conductive/electrified mounting rail to supply power from the grip 90 to the modular accessories within the housing of the MAS 100.

The MAS 100 may further comprise a display system 300 (FIG. 7-11) which includes a display, wherein the display system 300 is communicatively connected to each accessory while each accessory is removably secured within each slot, wherein data corresponding to each accessory is received by the display system 300, and wherein information corresponding to the data is displayed on the display. For example, the charge remaining of the common power source 260 may be displayed on the display. Weapon bearing may also be displayed, preferably inputted by an internal compass (e.g. of digital type). The compass may have the capability for declination adjustments in order to factor in magnetic deviation from the metal of the rifle. The compass may be a modular accessory or may alternatively be integral with the rifle. The distance of range-to-target may also be displayed, preferably inputted from a laser rangefinder modular accessory. As such, the display system functions to provide a situational awareness display.

The handguard may be the type shown in FIG. 6 or may alternatively comprise at least one rail. As is widely known, the handguard may include an inner liner typically composed of a metal such as aluminum or aluminum alloy. The tray, holders, sleeves, platform, modular accessories' outer casings, housing, handguard, and rail may be composed of, for example, molded heat-resistant plastic, polymers, metal, or combinations thereof.

The MAS of the present invention as described above and below fits existing rifle configurations without significant modification to the basic rifle components and is capable of exchangeably mounting modular accessories thereto in plug-and-play fashion and therefore has significant advantages. For example, incorporating the MAS of the present invention in place of the bottom handguard (and associated heat-shield liner) eliminates weight and reduces bulk, and therefore, costs are significantly reduced. Control of some or all of the modular accessories may be consolidated into preferably one interface thereby increasing ease of use while reducing weight and associated costs. Providing a MAS as described above, has significant advantages such as it easily attaches to a rifle, houses a plurality of accessories simultaneously, eliminates the need to replace an entire assembly if one accessory is non-functioning, allows for adjustability of the modular accessories, reduces or eliminates the need to calibrate when replacing accessories, powers a plurality of accessories simultaneously, reduces learning curve, increases up-time and time to achieve combat-ready state, and has a streamlined housing.

The streamlined and ergonomic design of the housing of the MAS of the present invention allows for easier use as well as reduced learning curve due to a common form factor. Other firearm developers employ accessories that can be attached anywhere on rail mount systems. Therefore, there is no location commonality of the rail-mounted accessories when comparing one rifle system to another. Moreover, the exterior of the housing of the MAS of the present invention is preferably smooth as compared to both rail mount systems and their rail-mounted accessories. Therefore, a reduction of the potential for snagging along sharp edges (e.g. wall edges, door edges, etc.) is realized. Individual rail-mounted accessories designed by various manufacturers are typically very angular, resulting in snagging and shearing effects. Furthermore, each accessory may be replaced at a lower cost per item because they will not require individual protective shells. Instead, the housing of the MAS provides a protective shell for all the modular accessories. Therefore, this plug-and-play design reduces overall life-cycle replacement cost.

As mentioned above, the present invention utilizes plug-and-play modularity, individual modular accessories may more easily and affordably be replaced on an as-needed case-by-case basis because each component snaps into their own individual slot. These slots are housed inside the ergonomic, streamlined housing. The housing will attach directly to the rifle, replacing a portion of a conventional handguard. The slots will have their own dialing for sight alignment. Therefore, when an modular accessory breaks (e.g. the visible laser), then it may be replaced with another with minimal to no re-sighting because the slot has already been properly aligned.

The contemplated modifications and variations specifically mentioned above and below are considered to be within the spirit and scope of the present invention.

Those of ordinary skill in the art will recognize that various modifications and variations may be made to the embodiments described above without departing from the spirit and scope of the present invention. For example, instead of protrusions/indentations 210, 210*i*, other type of fastening mechanisms (e.g. of magnetic-type) may alternatively be employed to removably secure modular accessories within the slots. Moreover, the shape, size, number, locations, pattern/distribution, and/or type of modular accessory and corresponding slots may be different than what is described above or shown in the drawings, and each is dependent on the design of the overall rifle. Additionally, future modular accessories that have not yet been developed or used in commerce may be employed as the modular accessories described in the present invention. Also, additional or different adjustment devices may be employed such as for fine-tuning adjustment purposes (e.g. fine-adjustment screws) and may effect adjustment in one or more axes. Further, rifles having different barrel lengths and handguard lengths may be employed. The length between the front collar 36 and the rear collar 38 would therefore be correspondingly adjusted in length to accommodate the different lengths between the Delta-ring 29 and the cap 31. Yet further, the description above assumes the handguard comprises half the axial circumference surrounding the barrel 21. However, the handguard may alternatively comprise a smaller or larger axial circumference surrounding the barrel 21, while the remaining axial circumference surrounding the barrel 21 is populated by the housing of the MAS 100 such that a combination of the handguard and housing surrounds the barrel completely in an axial manner. Note that the handguard may comprise multiple portions or multiple rails that are partly axially disposed surrounding the barrel (e.g. top and side rails similar to those shown in FIG. 2). Also note that the tray 151 or platform 161 may optionally be removed from the housing for accessing, or to make x-axis or z-axis adjustments to, any of the holders, sleeves, modular accessories. These adjustments may be made manually or via adjustment devices. Although the present invention is described above with reference to an M4, M16, or AR-15 type rifles, other firearms having handguards may utilize the MAS of the present invention. Moreover, although the present invention is described above with reference to the utilization of a connection system including a Delta-ring type connector 29, other connection systems without Delta-ring type connectors may alternatively be employed for removably securing the handguard and the housing to the rifle. It is therefore to be understood that the present invention is not limited to the particular embodiments disclosed above, but it is intended to cover such modifications and variations as defined by the following claims.

What is claimed is:

1. A rifle comprising:

a barrel extending along a longitudinal axis;

a handgrip;

a top handguard partly axially surrounding the barrel; and a modular accessory system comprising:

a housing; and a modular accessory support system positioned within the housing, wherein the support system includes at least two modular accessory slots, wherein each modular accessory slot is configured to removably secure a modular accessory therein such that each accessory is individually adjustable in a first axis and a second axis while being removably secured within each slot, wherein the first axis is perpendicular from the second axis, and wherein each modular accessory slot is positioned in an interior space within the housing;

wherein the housing partly axially surrounds the barrel and is positioned vertically below and axially adjacent to the top handguard, and wherein the handgrip is positioned vertically below the longitudinal axis of the barrel, when the rifle is held with the handgrip pointing downward, such that a combination of the top handguard and the housing surrounds the barrel completely in an axial manner;

wherein the top handguard and the housing combine at an interface having an aperture, and wherein the interior space within the housing is in communication with the aperture such that modular accessories can be removably installed within each modular accessory slot through said aperture; and wherein the top handguard and the housing are removably secured to the rifle via a Delta-ring connector.

2. The rifle of claim 1, wherein the support system comprises a tray that contains holders that define the at least two slots, and wherein the individual adjustability of each accessory is achieved via adjustment of a corresponding one of the holders.

3. The rifle of claim 2, wherein the tray is adjustable in a third axis and a fourth axis thereby effecting adjustment of the accessories in a combined manner, and wherein the third axis is perpendicular from the fourth axis.

4. The rifle of claim 1, wherein the support system comprises a platform that includes the at least two slots.

5. The rifle of claim 4, wherein the platform is adjustable in a third axis and a fourth axis thereby effecting adjustment of the accessories in a combined manner, and wherein the third axis is perpendicular from the fourth axis.

6. The rifle of claim 1, wherein the modular accessory system further comprises a common power source electrically connected to each accessory while each accessory is removably secured within each slot, and wherein each accessory is powered by the common power source.

7. The rifle of claim 1, wherein each modular accessory slot is positioned non-externally to the housing.

8. A rifle comprising:

a barrel extending along a longitudinal axis;

a handgrip;

a top handguard partly axially surrounding the barrel; and a modular accessory system comprising:

a housing; and a modular accessory support system positioned within the housing, wherein the support system includes at least two modular accessory slots, wherein each modular accessory slot is configured to removably secure a modular accessory therein such that each accessory is individually adjustable in a first axis and a second axis while being removably secured within each slot, wherein the first axis is perpendicular from the second axis, and wherein each modular accessory slot is positioned non-externally to the housing and in an interior space within the housing;

wherein the housing partly axially surrounds the barrel and is positioned vertically below and axially adjacent to the top handguard, and wherein the handgrip is positioned vertically below the longitudinal axis of the barrel, when the rifle is held with the handgrip pointing downward, such that a combination of the top handguard and the housing surrounds the barrel completely in an axial manner;

wherein the top handguard and the housing combine at an interface having an aperture, and wherein the interior space within the housing is in communication with the aperture such that modular accessories can be removed from each modular accessory slot through said aperture; and wherein the top handguard and the housing are removably secured to the rifle via a Delta-ring connector.

9. The rifle of claim 8, wherein the support system comprises a tray that contains a holder that defines each of the at least two slots, wherein individual adjustability of each accessory is achieved via adjustment of a corresponding holder, and wherein the tray is adjustable thereby effecting adjustment of each accessory in a combined manner.

10. The rifle of claim 8, wherein each accessory is capable of being accessed via an opening within the housing that is exposed upon separation of the housing from the top handguard, and wherein at least a portion of the barrel resides in at least a portion of the opening when the housing is not separated from the top handguard.

11. The rifle of claim 8, wherein each accessory is capable of being accessed via an opening within the housing that is exposed upon separation of the housing from the top handguard, and wherein the opening is located at a top side of the housing.

12. The rifle of claim 8, wherein the housing includes a door that is movable between an open position and a closed position, and wherein each accessory is capable of being accessed via an opening within the housing that is exposed when the door is in the open position.

13. The rifle of claim 12, wherein the door is located at a bottom side of the housing.

14. The rifle of claim 12, wherein the interior space within the housing is accessible via the opening, and wherein each modular accessory slot is contained entirely within the interior space.

15. The rifle of claim 8, wherein each accessory is capable of being accessed via a front surface of the housing.

16. The rifle of claim 8, wherein the housing includes a front cover that is movable between an open position and a closed position, and wherein each accessory is capable of being accessed via a front surface of the housing that is exposed when the front cover is in the open position.

17. The rifle of claim 8, wherein the modular accessory system further comprises a display system which includes a display, wherein the display system is communicatively connected to each accessory while each accessory is removably secured within each slot, wherein data corresponding to each accessory is received by the display system, and wherein information corresponding to the data is displayed on the display.

18. The rifle of claim 8, wherein the support system comprises a platform that includes the at least two slots, and wherein the platform is adjustable thereby effecting adjustment of each accessory in a combined manner.

19. The rifle of claim 8, wherein each modular accessory slot is contained entirely within the interior space within the housing.

20. A modular accessory system for use with a rifle having a barrel and a handguard partly axially surrounding the barrel, the modular accessory system comprising:

a housing; and a modular accessory support system positioned within the housing, wherein the support system includes at least two modular accessory slots, wherein each modular accessory slot is configured to removably secure a modular accessory therein such that each accessory is individually adjustable in a first axis and a second axis while being removably secured within each slot, wherein the first axis is perpendicular from the second axis, and wherein each modular accessory slot is positioned non-externally to the housing and in an interior space within the housing;

wherein the housing is configured to partly axially surround the barrel and is positioned axially adjacent to the handguard, such that a combination of the handguard and the housing surrounds the barrel completely in an axial manner;

wherein the handguard and the housing combine at an interface which resides in a plane, wherein the barrel at least partly resides in the plane, wherein the interface has an aperture, and wherein the interior space within the housing is in communication with the aperture such that modular accessories can be removed from each modular accessory slot through said aperture; and wherein the handguard and the housing are configured to be removably secured to the rifle via a Delta-ring connector.

* * * * *